US012252969B2

(12) United States Patent
Kolyshkin et al.

(10) Patent No.: US 12,252,969 B2
(45) Date of Patent: Mar. 18, 2025

(54) UNDERCURED STATOR FOR MUD MOTOR

(71) Applicant: Schlumberger Technology Corporation, Sugar Land, TX (US)

(72) Inventors: Anton Kolyshkin, Katy, TX (US); Lillian Guo, Houston, TX (US); Yuxiang Liu, Rosharon, TX (US); Miranda Amarante, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/123,169

(22) Filed: Dec. 16, 2020

(65) Prior Publication Data

US 2021/0189848 A1 Jun. 24, 2021

Related U.S. Application Data

(60) Provisional application No. 62/950,469, filed on Dec. 19, 2019.

(51) Int. Cl.

| | |
|---|---|
| ***E21B 43/12*** | (2006.01) |
| ***E21B 4/02*** | (2006.01) |
| ***F04C 13/00*** | (2006.01) |

(52) U.S. Cl.

CPC ..... *E21B 43/121* (2013.01); *E21B 4/02* (2013.01); *F04C 13/008* (2013.01); *F04C 2230/20* (2013.01); *F04C 2240/10* (2013.01); *Y10T 29/49242* (2015.01)

(58) Field of Classification Search

CPC ..... E21B 43/121; E21B 4/02; F04C 13/008; F04C 2230/20; F04C 2240/10; F04C 2230/40; F04C 2/1075; Y10T 29/49242

See application file for complete search history.

(56) References Cited

U.S. PATENT DOCUMENTS 1,392,894 A * 10/1921 Lloyd ..... B29C 73/22 152/506
5,680,315 A 10/1997 Rimondi
5,784,283 A 7/1998 Rimondi et al.

(Continued)

FOREIGN PATENT DOCUMENTS

CN 102587827 A 7/2012
RU 2209911 C1 8/2003

(Continued)

OTHER PUBLICATIONS

International Preliminary Report on Patentability issued in PCT Application No. PCT/US2020/065199 mailed Jun. 30, 2022, 8 pages.

(Continued)

*Primary Examiner* — Robert E Fuller
(74) *Attorney, Agent, or Firm* — Bryan K. Adams

(57) ABSTRACT

A stator for a mud motor and methods for manufacturing and using the same, of which one such method includes obtaining a mud motor having a stator made at least partially from a rubber. At least a portion of the rubber is cured by at most about 90%. The method also includes deploying the mud motor into a well as part of a drill string. The rubber is not further cured prior to deploying the mud motor into the well. The method further includes generating torque using the mud motor by pumping a mud through the stator.

19 Claims, 9 Drawing Sheets

(56) References Cited

U.S. PATENT DOCUMENTS

| | | | | |
|---|---|---|---|---|
| 7,128,145 | B2 * | 10/2006 | Mickey | E21B 33/128 277/654 |
| 7,517,202 | B2 * | 4/2009 | Delpassand | F04C 2/1075 418/48 |
| 8,944,789 | B2 * | 2/2015 | Butuc | F04C 2/1075 418/152 |
| 9,309,884 | B2 * | 4/2016 | Akbari | F04C 2/1071 |
| 10,549,489 | B2 | 2/2020 | Ogale | |
| 2002/0084029 | A1 | 7/2002 | Turner | |
| 2004/0031605 | A1 | 2/2004 | Mickey | |
| 2006/0153724 | A1 | 7/2006 | Delpassand | |
| 2007/0011873 | A1 | 1/2007 | Teale | |
| 2009/0169364 | A1 | 7/2009 | Downton | |
| 2011/0116961 | A1 | 5/2011 | Akbari et al. | |
| 2013/0118247 | A1 | 5/2013 | Akbari | |
| 2016/0036284 | A1 | 2/2016 | Meng et al. | |
| 2017/0030184 | A1 | 2/2017 | Ba | |

FOREIGN PATENT DOCUMENTS

| | | | |
|---|---|---|---|
| RU | 112861 | U1 | 1/2012 |
| RU | 2652725 | C1 | 4/2018 |
| RU | 2669640 | C1 | 10/2018 |
| WO | 2013071005 | A1 | 5/2013 |

OTHER PUBLICATIONS

International Search Report and Written Report of International Patent Application No. PCT/US2020/065199 dated Mar. 18, 2021, 11 pages.

* cited by examiner

UNDERCURED STATOR FOR MUD MOTOR

CROSS-REFERENCE TO RELATED APPLICATIONS

This application claims the benefit of, and priority to, U.S. Patent Application No. 62/950,469 filed on Dec. 19, 2019, which is incorporated herein by this reference in its entirety.

BACKGROUND

Downhole or "mud" motors are used in drilling assemblies, e.g., in the oil and gas industry, to turn a drill bit at the end of a drill string, generate electricity, or otherwise produce rotation of a tool within the wellbore. The mud motors may be powered by flowing drilling fluid ("mud") through the drill string. The mud is also used to lubricate the drill string and to carry away cuttings in the annulus between the drill string and the wellbore wall. Thus, the mud may include particulate matter, potentially in addition to solvents and other liquids. As such, the mud, while available to drive the downhole mud motor, presents a harsh working environment for the components thereof.

One type of mud motor that has been used with success in this environment is a progressive cavity or Moineau-style motor. This type of mud motor generally includes a helical rotor received inside a bore of a stator. The stator bore generally has inwardly-extending, curved lobes alternating with outwardly-extending, curved cavities or "chambers". Pressure in the fluid drives the helical rotor to rotate within the bore of the stator. To accommodate the harsh environment, while avoiding damaging the rotor, at least the interior of the stator may be made from a relatively soft material, such as rubber. The rubber, however, is prone to wear and cracking, which may alter the geometry of the stator, reducing the efficiency of the mud motor. Accordingly, fully cured and hardened rubber is generally sought to resist such geometry changes and maintain high efficiency throughout the lifecycle of the stator.

Upon reaching the end of the stator's life-cycle, the drilling assembly may have to be pulled out of the well, and brought back to the surface so a new stator (or at least a new rubber component thereof) may replace the worn one. Accordingly, the stator wearing out is a source of non-productive time for the drilling operation.

SUMMARY

Embodiments of the disclosure may provide a stator for a mud motor, the stator including a body made at least partially from a rubber. At least a portion of the rubber is at most about 90% cured.

Embodiments of the disclosure may also provide a method for manufacturing a stator for a mud motor. The method includes positioning a rubber body in a mold, such that the rubber body defines a helical inner bore. The rubber body is substantially uncured. The method may also include curing the rubber body at a temperature and for a time sufficient to cure at least a portion of the rubber body by at most about 90%, and allowing the rubber body to cool so as to maintain the at least a portion of the rubber body at about 90% cured.

Embodiments of the disclosure may further provide a method that includes obtaining a mud motor having a stator made at least partially from a rubber. At least a portion of the rubber is cured by at most about 90%. The method also includes deploying the mud motor into a well as part of a drill string. The rubber is not further cured prior to deploying the mud motor into the well. The method further includes generating torque using the mud motor by pumping a mud through the stator.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the invention. The first object and the second object are both objects, respectively, but they are not to be considered the same object.

The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques and workflows that are in accordance with some embodiments. Some operations in the processing procedures, methods, techniques and workflows disclosed herein may be combined and/or the order of some operations may be changed.

Figure 1:
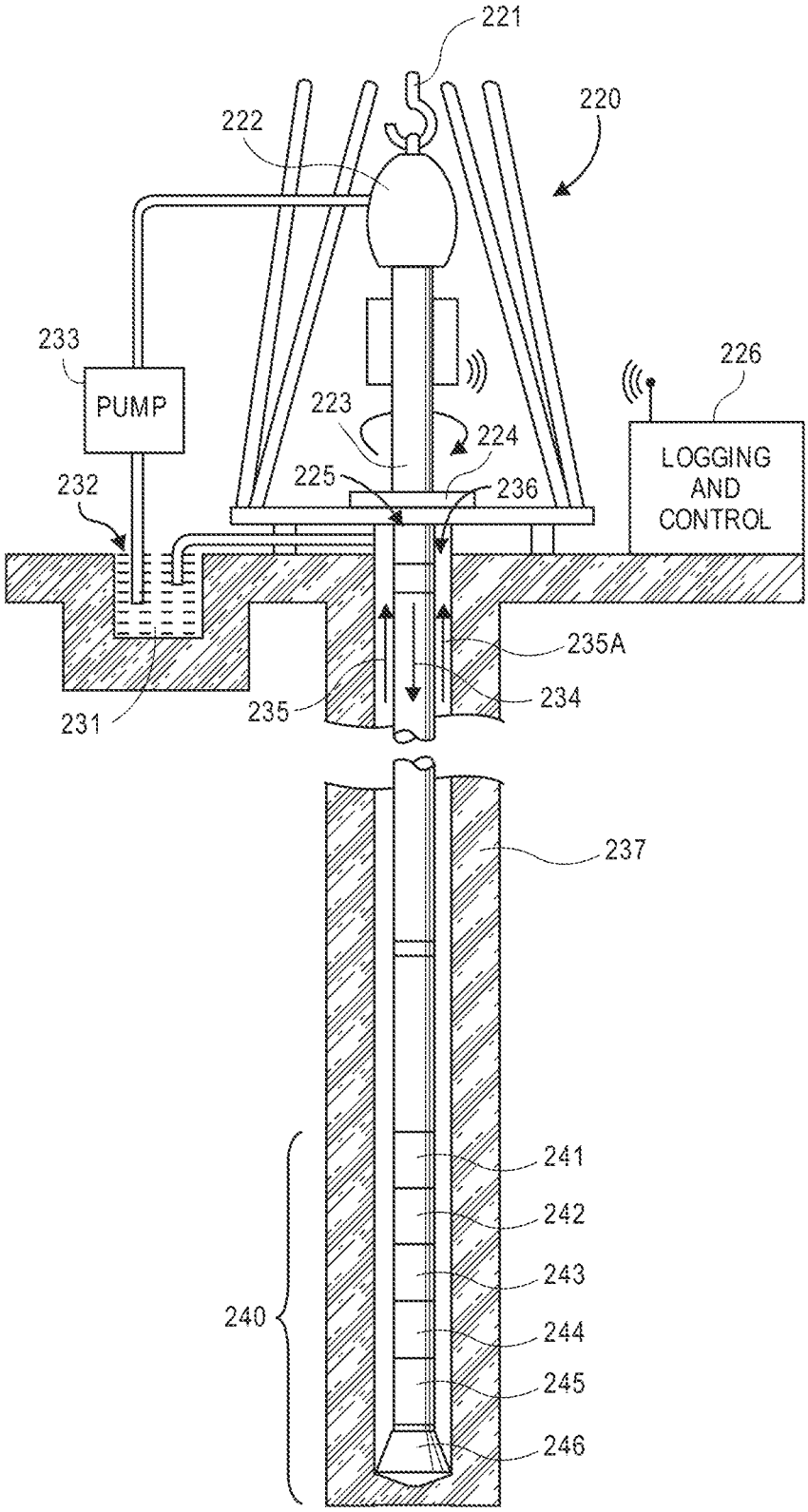
FIG. 1 illustrates an example of a wellsite system, according to an embodiment.

FIG. 1 illustrates a wellsite system in which data to be used according to examples of the present disclosure may be used. The wellsite can be onshore or offshore. In this example system, a borehole is formed in subsurface formations 237 by rotary drilling in a manner that is well known. A drill string 225 is suspended within a borehole 236 and has a bottom hole assembly (BHA) 240 which includes a drill bit 246 at its lower end. A surface system 220 includes platform and derrick assembly positioned over the borehole 236, the assembly including a rotary table 224, kelly (not shown), hook 221, and rotary swivel 222. The drill string 225 is rotated by the rotary table 224 energized by means not shown, which engages the kelly (not shown) at the upper end 223 of the drill string 225. The drill string 225 is suspended from the hook 221, attached to a traveling block (also not shown), through the kelly (not shown) and the rotary swivel 222 which permits rotation of the drill string 225 relative to the hook 221. As is well known, a top drive system could be used instead of the rotary table system shown in FIG. 1.

In the illustrated example, the surface system further includes drilling fluid or mud 232 stored in a pit 231 formed at the well site. A pump 233 delivers the drilling fluid to the interior of the drill string 225 via a port (not shown) in the swivel 222, causing the drilling fluid to flow downwardly through the drill string 225 as indicated by the directional arrow 234. The drilling fluid exits the drill string via ports (not shown) in the drill bit 246, and then circulates upwardly through an annulus region between the outside of the drill string 225 and the wall of the borehole 236, as indicated by the directional arrows 235 and 235A. In this manner, the drilling fluid lubricates the drill bit 246 and carries formation cuttings up to the surface as it is returned to the pit 231 for recirculation.

The BHA 240 of the illustrated embodiment may include a measuring-while-drilling (MWD) tool 241, a logging-while-drilling (LWD) tool 244, a rotary steerable directional drilling system 245 and motor, and the drill bit 246. It will also be understood that more than one LWD tool and/or MWD tool can be employed, e.g. as represented at 243.

The LWD tool 244 is housed in a special type of drill collar, as is known in the art, and can contain one or a plurality of known types of logging tools. The LWD tool 244 may include capabilities for measuring, processing, and storing information, as well as for communicating with the surface equipment. In the present example, the LWD tool 244 may any one or more well logging instruments known in the art, including, without limitation, electrical resistivity, acoustic velocity or slowness, neutron porosity, gamma-gamma density, neutron activation spectroscopy, nuclear magnetic resonance and natural gamma emission spectroscopy.

The MWD tool 241 is also housed in a special type of drill collar, as is known in the art, and can contain one or more devices for measuring characteristics of the drill string and drill bit. The MWD tool 241 further includes an apparatus 242 for generating electrical power to the downhole system. This may typically include a mud turbine generator powered by the flow of the drilling fluid, it being understood that other power and/or battery systems may be employed. In the present embodiment, the MWD tool 241 may include one or more of the following types of measuring devices: a weight-on-bit measuring device, a torque measuring device, a vibration measuring device, a shock measuring device, a stick slip measuring device, a direction measuring device, and an inclination measuring device. The power generating apparatus 242 may also include a drilling fluid flow modulator for communicating measurement and/or tool condition signals to the surface for detection and interpretation by a logging and control unit 226.

Figure 2:
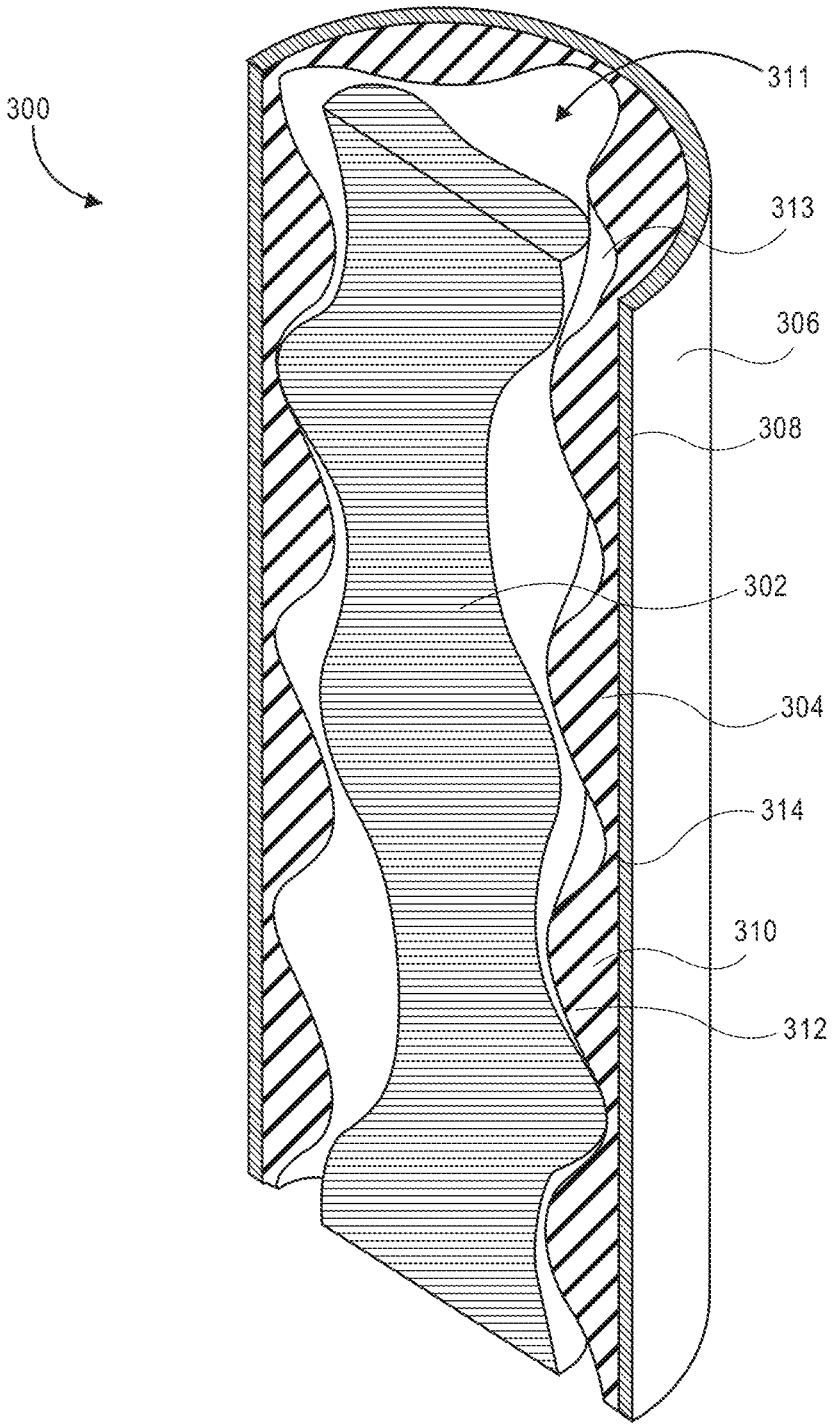
FIG. 2 illustrates a cross-sectional view of a portion of a mud motor, according to an embodiment.

FIG. 2 illustrates sectional view of a mud motor 300 (an example of the apparatus 242 of FIG. 1), according to an embodiment. As shown, the mud motor 300 may be a Moineau-style, progressive-cavity motor, and may thus include a helical rotor 302 and a corresponding stator 304. The rotor/stator combination may be housed in a tube 306, which may surround an outer surface 308 of the stator 304. As such, the outer surface 308 may interface (e.g., contact potentially via a layer of adhesive and/or one or more other layers) with the tube 306 when assembled therein.

The stator 304 may have a body 310 made at least partially of rubber. The body 310 may define an inner bore 311, through which the rotor 302 is received. The inner bore 311 may be configured to receive a drilling mud therethrough. The body 310 may have an inner surface 313 that defines the inner bore 311 extending axially through the stator 304. The inner surface 313 may be profiled, that is, not entirely cylindrical. For example, the inner surface 313 may define inwardly-extending lobes 312 alternating with outwardly-extending chambers 314. The combination of lobes 312 and chambers 314 may be configured to cooperate with the rotor 302 so as to promote rotation thereof with respect to the stator 304 in the presence of a fluid pressure differential across the axial length of the mud motor 300, according with the operating principles of a progressive-cavity motor.

The rubber that makes up at least a portion of the body 310 may be undercured. For example, at least a portion of the rubber may be cured at most about 90%, or at most about 70%, or between about 50% and about 90%, or between about 70% and about 90%. In this context, "about" means within a commercially-reasonable tolerance, e.g., +/−5%. Further, the curing percentage may be measured using differential scanning calorimetry (DSC), as will be explained in greater detail below.

Undercuring the rubber may result in a softer rubber, which may be more easily deformed (e.g., elastically). However, a surprising and unexpected result of using undercured rubber (rubber in which at least a portion of the rubber is cured less than about 90%) is that the rubber in the stator 304 has an increased fatigue life. That is, fatigue chunking, which is one primary mode of failure that reduces the life of the mud motor elastomer, may take longer to develop if the rubber is undercured. In particular, if the rubber proximal to the inner bore 311 (e.g., defining the inner surface 313 and extending by a relatively small, radially-outward distance therefrom) is cured less than about 90%, or less than about 70%, or any of the other ranges discussed above, the fatigue life unexpectedly increases.

Figure 3:
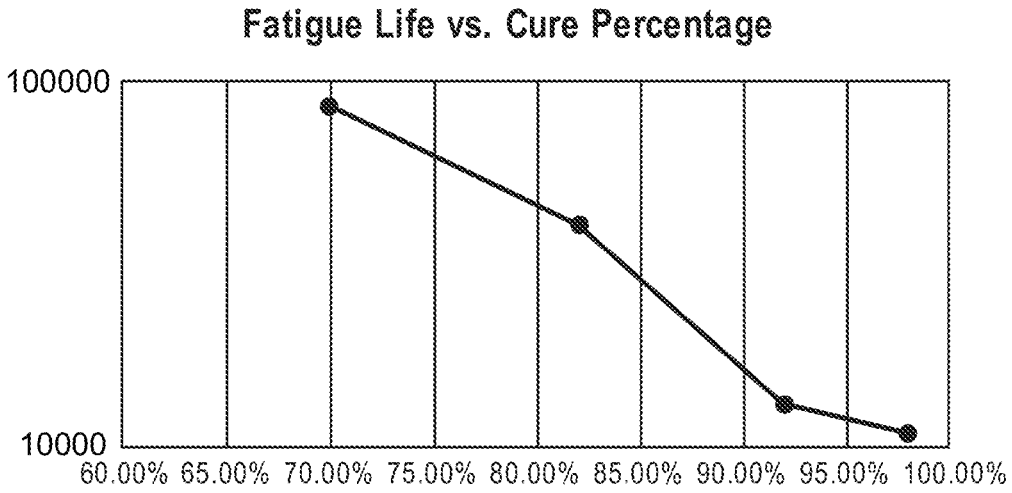
FIG. 3 illustrates a plot of fatigue life versus cure percentage for rubber in a stator of a mud motor, according to an embodiment.

FIG. 3 illustrates a plot of fatigue life (vertical axis) of a stator 304 as a function of curing percentage (horizontal axis) of the rubber making up at least the inner portion of the body 310, according to an embodiment. As shown, the number of cycles (fatigue life on the vertical axis) decreases at curing above 70%, and proceeds downward therefrom to fully-cured (approaching 100%) rubber. Thus, the undercured rubber stators 304 unexpectedly have a longer fatigue life than fully-cured stators.

Figure 4:
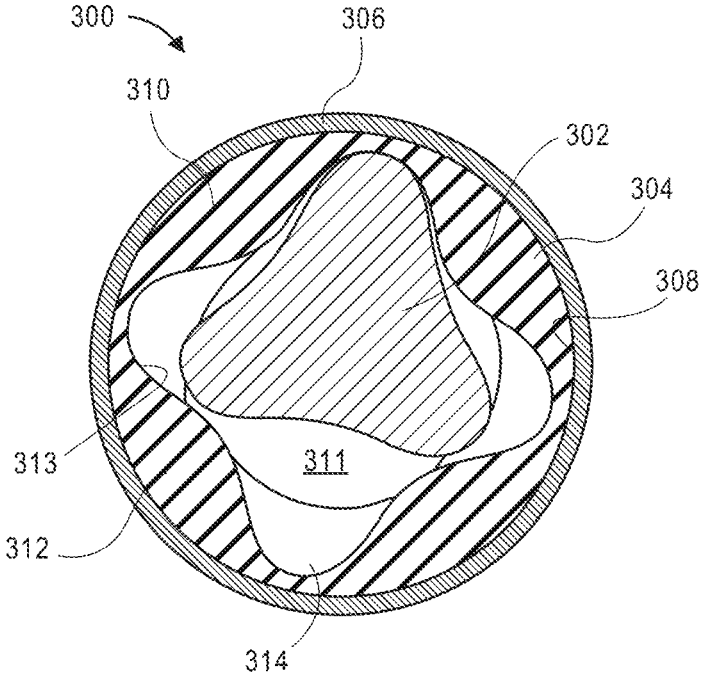
FIG. 4 illustrates an axial cross-sectional view of a portion of the mud motor, according to an embodiment.

FIG. 4 illustrates an axial, cross-sectional view of the mud motor 300, according to an embodiment. During production of the stator 304, the body 310 may be cured by heat applied to the outside thereof, which conducts radially-inward over time. The local curing percentage of the rubber that makes up the body 310 may generally be a function of preceding temperature history. Thus, considering any given radial line, the point on the body 310 that is raised to the lowest temperature (or, stated otherwise, raised above a curing temperature for the least amount of time) is the radially-innermost point. Thus, as proceeding circumferentially around the circle that the stator 304 defines, the inner surface 313 thereof defines the least-cured point at any given angle.

However, as can be readily appreciated from FIG. 4, the inner surface 313 is not entirely circular, but defines the alternating lobes 312 and cavities 314, as mentioned above. It will also be appreciated that any number of lobes 312 and cavities 314 may be employed in various different designs. As a consequence of the provision of lobes 312 and cavities 314, the amount of rubber between the outer surface 308 and the inner surface 313 may vary as proceeding around the stator body 310. As such, during the curing process, which, again, proceeds by heating the body 310 from the outside inwards, the rubber proximal to the inner surface 313 at the lobes 312 may be less cured than the rubber proximal to the inner surface 313 at the cavities 314. The amount of curing thus varies as proceeding circumferentially along the inner surface 313, but generally does not vary as proceeding circumferentially along the outer surface 308, which is cylindrical. In other words, the curing percentage of the rubber may be roughly a function of the radial location of the rubber, with rubber that is outward being more cured than rubber that is inward. This can also be referred to as a curing gradient, with the curing percentage increasing as proceeding radially outward. The curing gradient may not be linearly increasing (as proceeding outward), but may indicate a general trend of curing on the outside most and less as proceeding inward.

Figure 5:
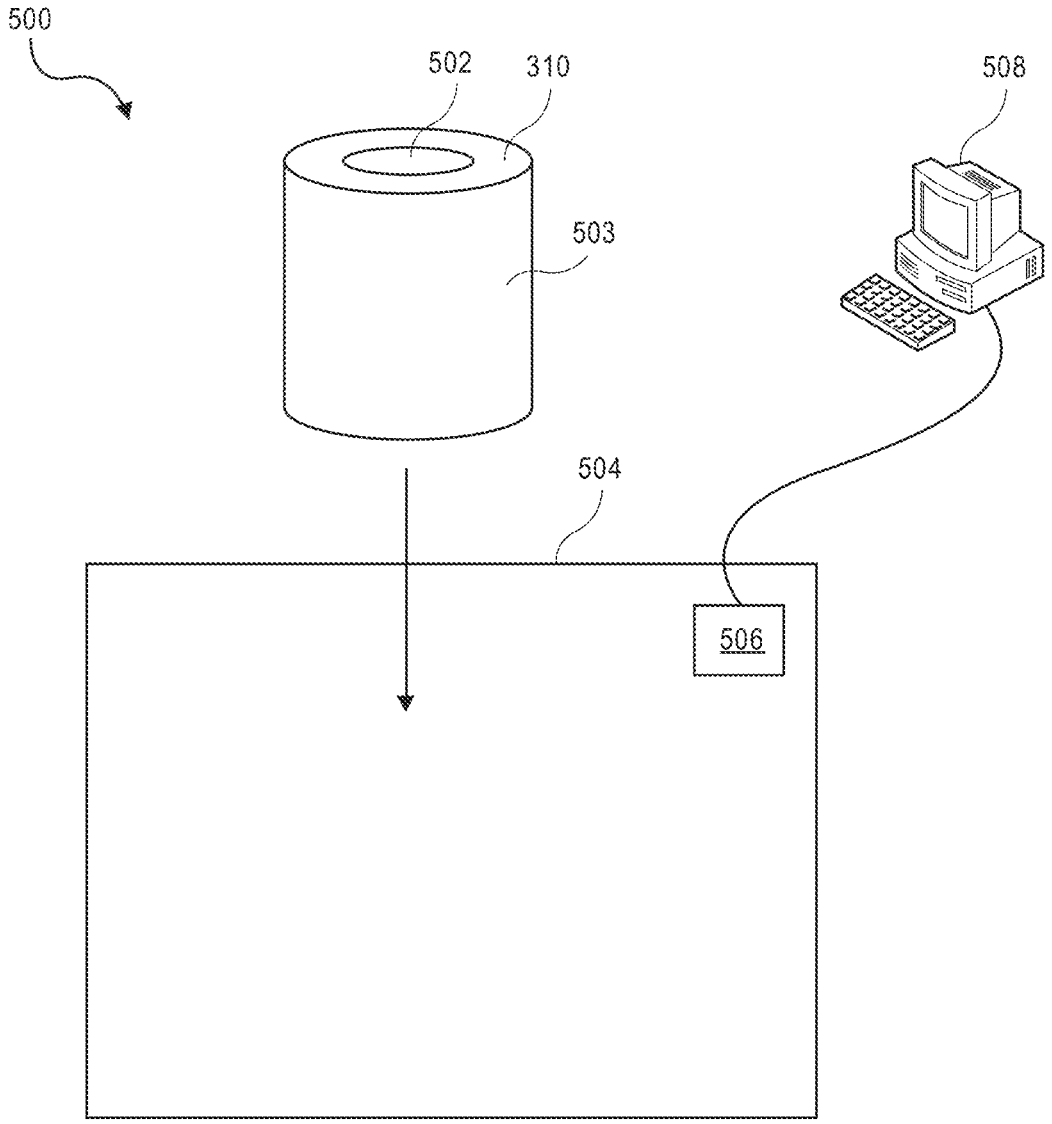
FIG. 5 illustrates a schematic view of a system for curing a body of a stator, according to an embodiment.

FIG. 5 illustrates a simplified schematic view of a system 500 for partially curing the rubber of the body 310 of the stator 304, according to an embodiment. The stator 304 is initially made by placing uncured rubber around a core 502 and within a tube 503. For example, the uncured rubber may be injected under pressure. The core 502 may provide the helical shape of lobes and cavities desired for the finished stator body 310. As such, the core 502 and the tube 503 may provide a mold for the uncured rubber of the body 310.

The body 310, along with the core 502 and tube 503, may be placed inside a curing device 504, which may be an autoclave or a vulcanization bath, to name just two examples. In instances where the rubber would be fully cured, a simple calculation of time and temperature may be made, and the rubber disposed in the curing device 504 until at least fully cured, e.g., the curing percentage closely approaches 100%. Accordingly, in such cases, bodies of differently-sized stators can be cured together, without substantially impacting the curing process.

However, in embodiments herein, at least a portion of the body 310 is to be undercured, and thus the system 500 may include additional devices to more closely regulate the process. For example, the system 500 may include a heat flow sensor 506 and a data acquisition and process device (e.g., a computer 508) attached thereto. The heat flow sensor 506 may provide data representing the completeness of the curing process. Briefly, and without being bound by theory, the curing process begins endothermically, and may thus necessitate a heated environment (e.g., submerging in a liquid vulcanization bath, as shown in FIG. 5). Once the reaction is initiated, however, the curing process may become exothermic. When curing is done, the exothermic reaction stops. Accordingly, the heat flow sensor 506 may be used to track heat input and/or output to the device 504, so as to determine an amount of curing that has occurred in the body 310.

Figure 6:
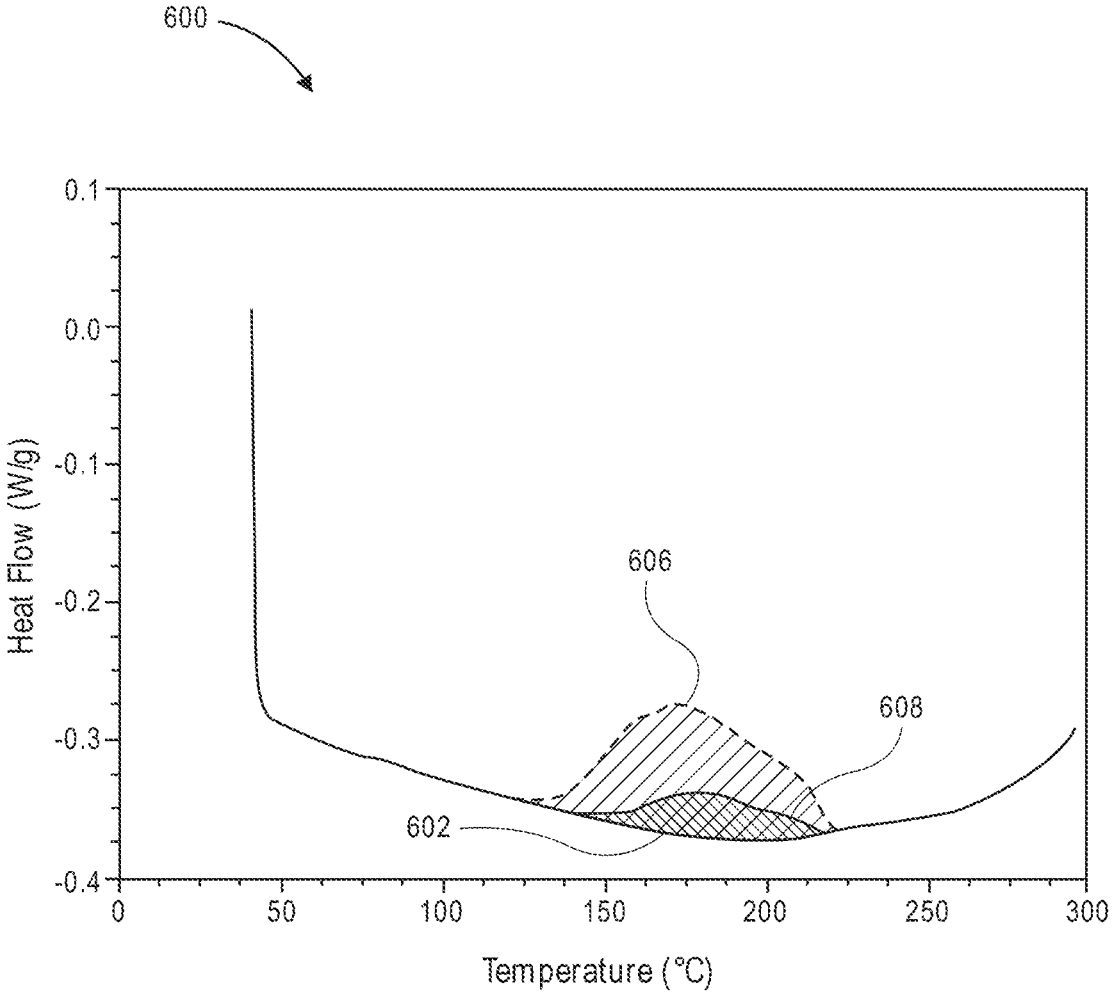
FIG. 6 illustrates a plot generated by a differential scanning calorimetry (DSC) test of a rubber sample, according to an embodiment.

FIG. 6 illustrates a plot 600 generated by a DSC test of a rubber sample, according to an embodiment. For example, the DSC test may provide data representing an amount of the exothermic curing reaction that has been completed, which may be proportional to the curing percentage. During this test, the rubber sample is heated with a constant rate and the heat flow to the sample is measured. As shown in FIG. 6, heat flow (measured in Watts per gram) is plotted on the vertical axis as a function of temperature on the horizontal axis. Heat flow is negative because the heat is transferred to the rubber sample to increase its temperature.

The specific enthalpy of exothermic reaction may be computed by integration of an associated spike in the heat flow (e.g., the hatched areas in the FIG. 6). Generally, the curing percentage of a sample is inversely proportional to the enthalpy that the curing reaction shows in the DSC-derived plot 600. In other words, lower curing percentage corresponds to greater enthalpy in the curing reaction. For example, the peak 606, corresponds to a lower curing percentage than the peak 608, while the curve 602 showing no peak corresponds to a fully-cured sample. To measure the curing percentage, a sample of rubber with curing percentage to be determined is compared with a reference sample with 0% curing, i.e. fully uncured rubber. In this case the curing percentage of the tested sample is computed as: Curing $\%=(1-\Delta H/\Delta H_0)\times 100\%$, where $\Delta H$ and $\Delta H_0$ are the specific enthalpy of exothermic curing reacting of the tested and reference samples respectively.

Figure 7:
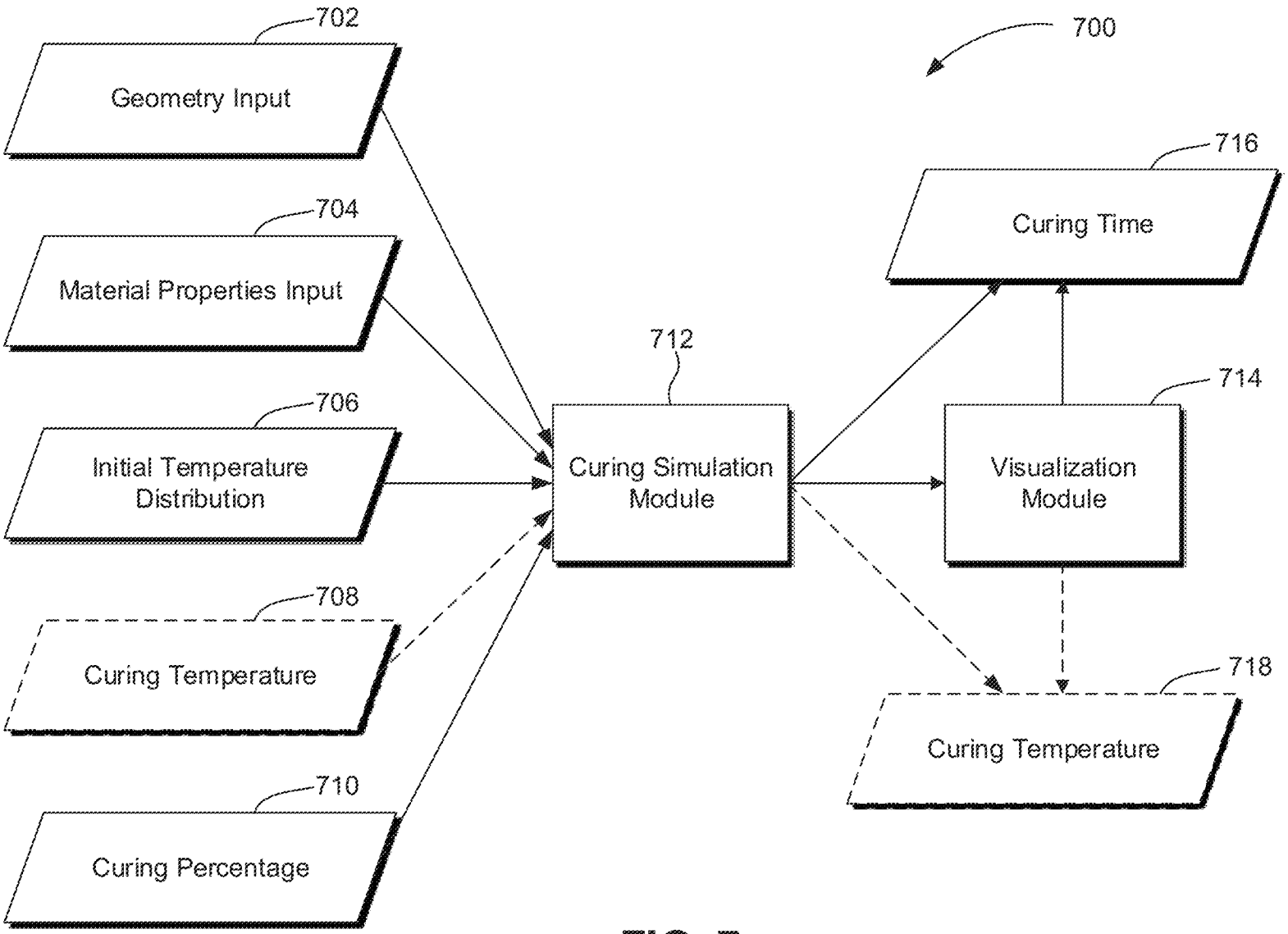
FIG. 7 illustrates a schematic view of a curing simulation system that may be employed to determine, e.g., curing time and temperature for a given stator, according to an embodiment.

In some embodiments, the time and temperature may be calculated using a digital model of the body 310 of a specific size, e.g., by computer simulation occurring prior to the curing process. FIG. 7 illustrates a schematic view of a simulation system 700 that may perform such calculations, according to an embodiment. The simulation system 700 may receive geometry inputs 702. For example, the geometry inputs 702 may include the physical measurements of the size and shape of the tube 503 and the core 502, as well as a core profile (e.g., number and geometry of lobes), which may define the cross-sectional dimensions of the rubber of the body 310. The simulation system 700 may also receive material properties input 704, which may include properties of the rubber being cured, the core 502, and the tube 503 in which the uncured body 310 may be positioned. For example, the input 704 may include input from a moving die rheometer (MDR), which may provide the time to 90% curing (t90), or any other amount of curing, for various initial temperatures for the tube 503, rubber of the body 310, and core 502. The simulation system 700 may further receive initial temperature distribution inputs 706 for the starting temperature of the tube 503, the rubber of the body 310, and the core 502. Inputs 708 and 710 may include curing temperature and desired curing percentage. In some embodiments, the curing temperature 708 may not be provided as an input, but may be an output of the simulation process, as described below, but in other embodiments, may be provided as an input.

These inputs 702-710 may be fed to a curing simulation module 712, which may include hardware and/or software configured to simulate a curing process based partially on the inputs. The curing simulation module 712 may then simulate the curing process using the parameters provided, and may provide outputs which may allow for planning of the curing process. For example, the curing simulation module 712 may provide a thermal profile output, which may specify start and end temperatures, at various durations (e.g., curing time), for the tube 503 and/or the core 502. In an embodiment, the output may include a plot of temperature versus time.

The output of the curing simulation module 712 may be provided to a visualization module 714, which may generate a visual display of the outputs, e.g., on a computer monitor or another type of display. For example, the plot may be visualized using visualization module 714, which may include a computer display. The visualization module 714 may also depict curing time 716 and/or curing temperature 718 for curing the modeled body 310, as determined by the curing simulation module 712. In some embodiments, however, the curing temperature may not be an output of the simulation module 712, but, as noted above, may be an input at 708.

Figure 8A:
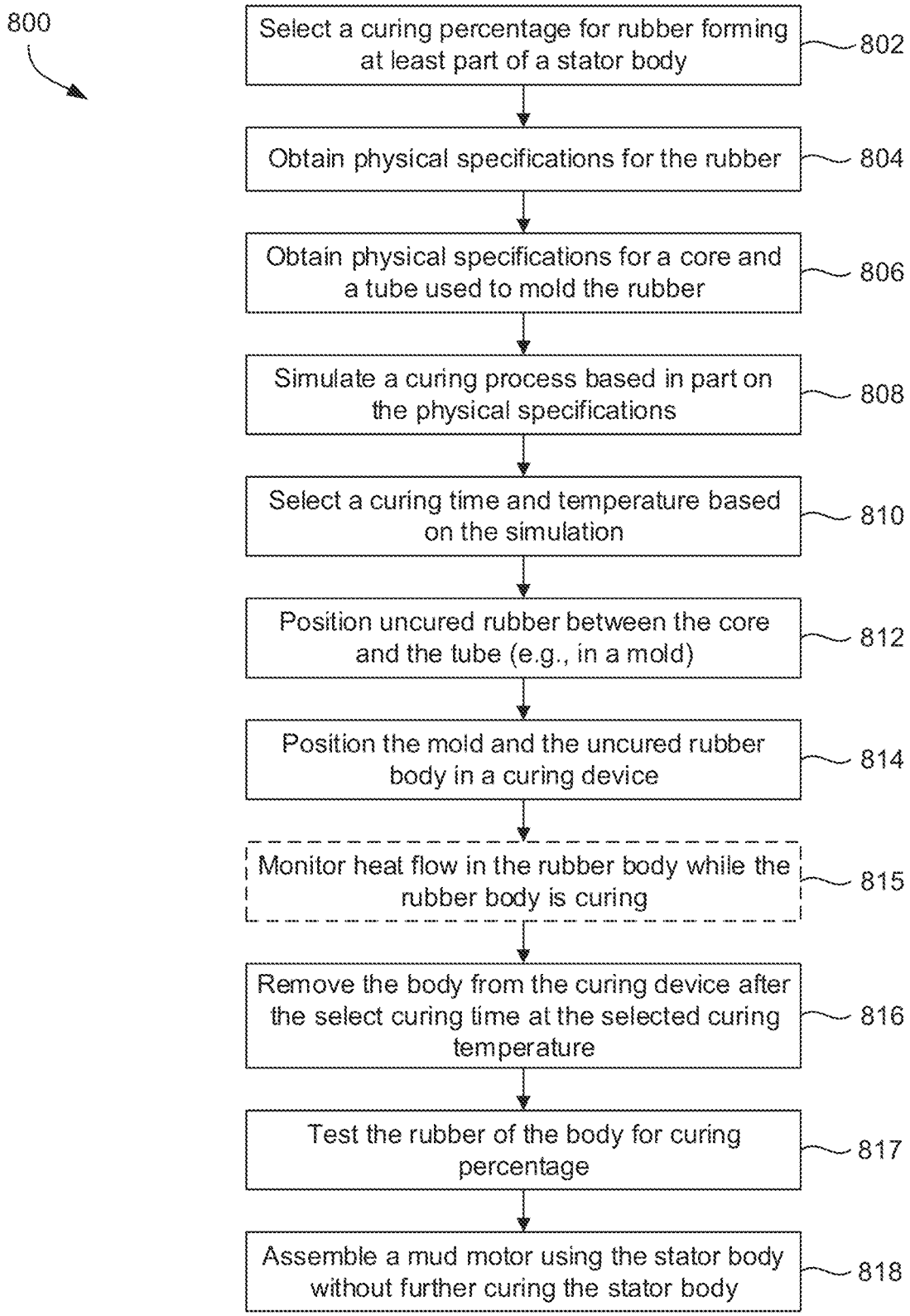
FIG. 8A illustrates a flowchart of a method for manufacturing a stator, according to an embodiment.

Referring now to FIG. 8A, there is shown a flowchart of a method 800 for manufacturing a stator, according to an embodiment. The method 800 may be best understood in view of the stator embodiments of FIGS. 2-7, and is thus described with reference thereto. It will be appreciated, however, that various embodiments of the method 800 may employ other structures.

The method 800 may include selecting a curing percentage for rubber forming at least part of the body 310 of the stator 304, as at 802. As noted above, the curing percentage may be selected for one or more specific portions of the body 310, e.g., proximal to the inner surface 313 at the lobes 312. In various embodiments, the curing percentage selected may be any value or range of values less than about 90%, less than about 70%, or between about 50% and about 90%. The curing percentage may be selected as a tradeoff between wear or fatigue life and other material properties, such as tensile strength of the body 310, Young's modulus of the body 310, mechanical strength (e.g., tensile strength) of the body 310, abrasion resistance of the body 310, etc., in various temperatures and times for drilling mud in a particular application. Further, the curing percentage may be selected at least partially based on finite element analysis (FEA) simulation of the body 310 in various conditions.

The method 800 may also include obtaining physical specifications of the stator 304, as at 804. The physical specifications may include a size of the stator 304 (e.g., inner diameter, outer diameter, etc.) and/or material properties thereof, such as, for example, heat capacity. The physical specifications may also include a geometry of the stator 304, e.g., number and positioning of lobes 312 therein.

The method 800 may further include obtaining physical specifications of the core 502 and the tube 503 between which the body 310 is to be at least partially cured, as at 806. The physical specifications may include size, geometry, and/or material properties.

The method 800 may include simulating a curing process of the body 310 based at least in part on the physical specifications collected at 804 and 806, as at 808. From this simulation, one or more curing times and/or temperatures may be determined. For example, several curing times may be determined for different temperatures. After the simulation is complete, the method 800 may then include selecting an elapsed time and temperature for curing the body 310, as at 810.

During or after such simulating, the method 800 may include positioning uncured rubber between the core 502 and the tube 503, such that the uncured rubber forms the desired shape of the body 310, as at 812. The method 800 may then proceed to placing the core 502, the tube 503 and the uncured rubber of the body 310 into the curing device 504 which is configured to apply the temperature selected at 810 to the core 502, tube 503, and body 310, as at 814.

The method 800 may then include removing the body 310 from the curing device 504, or otherwise allowing the body 310 to cool, after an elapsed time and/or upon reaching a temperature, as at 816. The elapsed time or temperature may be the same time and/or temperature selected at 810. Accordingly, after the body 310 has been in the curing device 504 for the elapsed time and/or raised to the desired temperature, at least a portion of the body 310 may be cured by approximately (within a commercially reasonable tolerance) of the curing percentage selected. For example, the curing percentage may be specified for a volume proximal to the inner surface 313 of the body 310.

In an embodiment, the method 800 may additionally, or potentially in lieu of the simulating worksteps discussed above, monitor (e.g., by taking one or more measurements) a heat flow in the rubber of the body 310 while it is curing (e.g., while in the curing device 504), as at 815. Accordingly, rather than or in addition to a predetermined time and/or temperature for curing, the method 800 may include removing the body 310 from the curing device 504 upon reaching a specified heat flow, which may be representative of a specific amount of curing having taken place, based on, e.g., an amount of heat being evolved by the exothermic curing reaction, as at 816. In addition, a piece of rubber can be taken from the body 310 after curing, and may be tested for curing percentage in order to confirm the obtained results, as at 817.

After removing the body 310 from the curing device 504, and without further curing the body 310, the body 310 may be assembled into the mud motor 300, as at 818. For example, the core 502 may be removed from the body 310, and the body 310 may receive the lobed rotor 302 therein. The undercured rubber of the body 310 may thus be configured to operate as at least a portion of the stator 304 in the mud motor 300. Accordingly, the mud motor 300 may be assembled into a drilling assembly and run into a well.

The body 310 may remain undercured at least until the drilling assembly is run into the well. In some circumstances, the heat of the downhole environment may serve to cure the body 310 further than during manufacture of the body 310. As such, during the lifecycle of the stator 304, the body 310 thereof may cure to a percentage that exceeds the curing percentage specified at 802, without departing from the scope of the present disclosure.

Figure 8B:
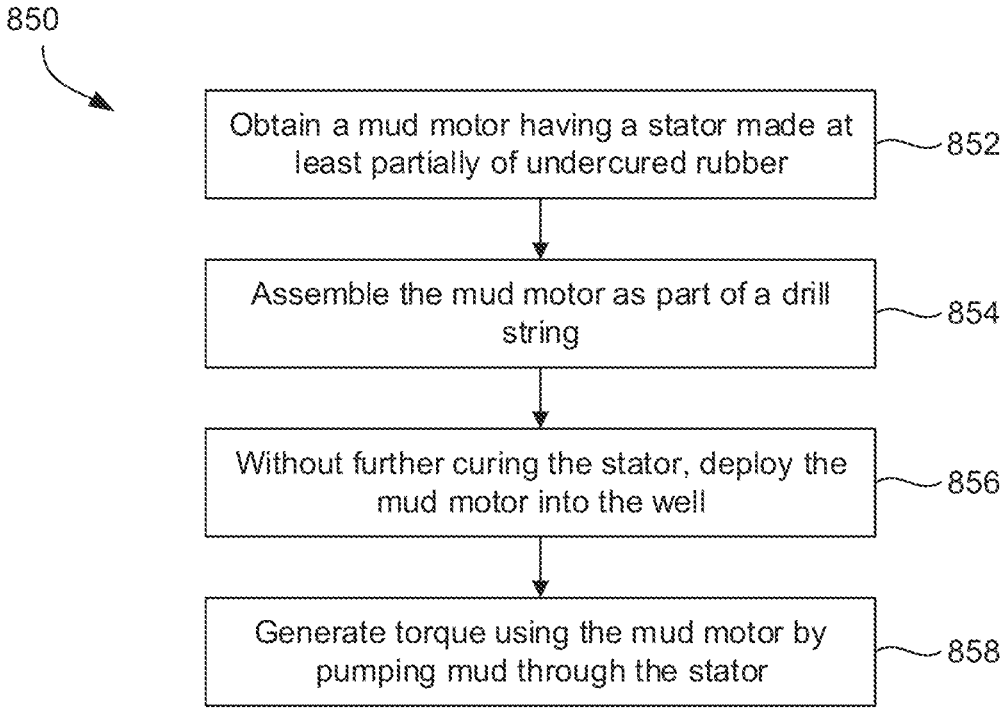
FIG. 8B illustrates a flowchart of a method for deploying a mud motor including the stator, according to an embodiment.

FIG. 8B illustrates a flowchart of another method 850, according to an embodiment. The method 850 may employ the stator 304, e.g., produced as described above. The method 850 may thus include obtaining a mud motor having a stator made at least partially of an undercured (e.g., at most about 90% cured) rubber, as at 852. The method 850 may then include assembling the mud motor as part of a drill string, as at 854. The undercured rubber of the stator may remain undercured before and during assembly at 854. Further, and again without further curing the undercured rubber of the stator 304, the mud motor 300 may be deployed into a well as part of the drill string, as at 856. During such deployment, the mud motor 300 may be used to generate torque, as at 858, e.g., by pumping drilling mud through the stator 304, so as to cause the rotor 302 to rotate. In some circumstances, the rubber of the stator 304 may further cure in the downhole environment.

In some embodiments, any of the methods of the present disclosure may be executed by a computing system. For example, the computing system may be used to provide the GUI 700, simulate the curing process, and/or execute at least a portion of the method(s) 800, 850. In another example, the same computing system, or a different computing system, may be employed to monitor the curing process and signal or otherwise cause the body 310 to be removed in response to reaching a calculated curing percentage.

Figure 9:
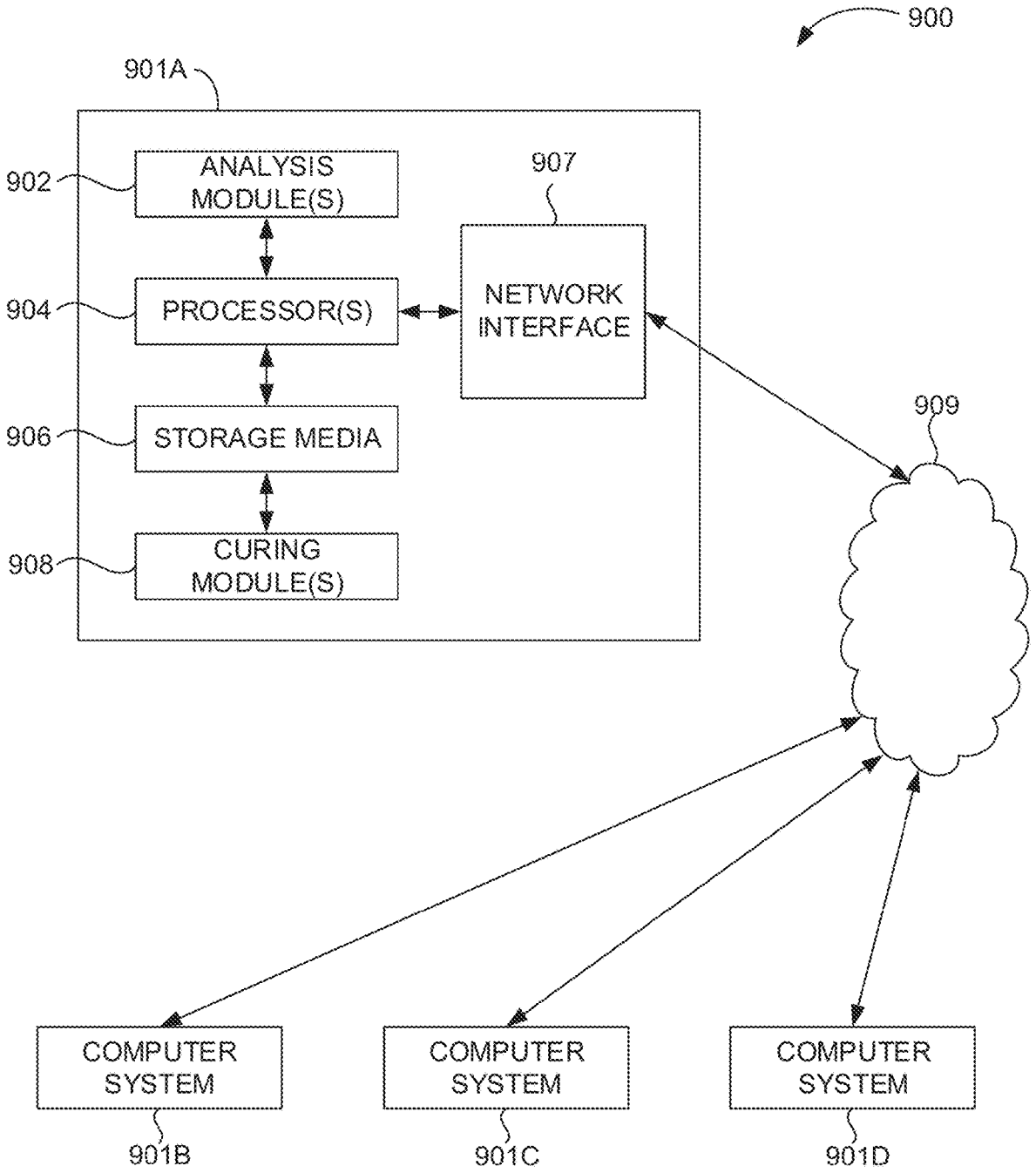
FIG. 9 illustrates a schematic view of a computing system, according to an embodiment.

FIG. 9 illustrates an example of such a computing system 900, in accordance with some embodiments. The computing system 900 may include a computer or computer system 901A, which may be an individual computer system 901A or an arrangement of distributed computer systems. The computer system 901A includes one or more analysis module(s) 902 configured to perform various tasks according to some embodiments, such as one or more methods disclosed herein. To perform these various tasks, the analysis module 902 executes independently, or in coordination with, one or more processors 904, which is (or are) connected to one or more storage media 906. The processor(s) 904 is (or are) also connected to a network interface 907 to allow the computer system 901A to communicate over a data network 909 with one or more additional computer systems and/or computing systems, such as 901B, 901C, and/or 901D (note that computer systems 901B, 901C and/or 901D may or may not share the same architecture as computer system 901A, and may be located in different physical locations, e.g., computer systems 901A and 901B may be located in a processing facility, while in communication with one or more computer systems such as 901C and/or 901D that are located in one or more data centers, and/or located in varying countries on different continents).

A processor can include a microprocessor, microcontroller, processor module or subsystem, programmable integrated circuit, programmable gate array, or another control or computing device.

The storage media 906 can be implemented as one or more computer-readable or machine-readable storage media. Note that while in the example embodiment of FIG. 9 storage media 906 is depicted as within computer system 901A, in some embodiments, storage media 906 may be distributed within and/or across multiple internal and/or external enclosures of computing system 901A and/or additional computing systems. Storage media 906 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In some embodiments, computing system 900 contains one or more curing module(s) 908. In the example of computing system 900, computer system 901A includes the curing module 908. In some embodiments, a single curing module may be used to perform some or all aspects of one or more embodiments of the methods. In alternate embodiments, a plurality of curing modules may be used to perform some or all aspects of methods.

It should be appreciated that computing system 900 is only one example of a computing system, and that computing system 900 may have more or fewer components than shown, may combine additional components not depicted in the example embodiment of FIG. 9, and/or computing system 900 may have a different configuration or arrangement of the components depicted in FIG. 9. The various components shown in FIG. 9 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

Controls, models and/or other interpretation aids may be refined in an iterative fashion; this concept is applicable to embodiments of the present methods discussed herein. This can include use of feedback loops executed on an algorithmic basis, such as at a computing device (e.g., computing system 900, FIG. 9), and/or through manual control by a user who may make determinations regarding whether a given step, action, template, model, or set of curves has become sufficiently accurate.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A stator for a mud motor, the stator comprising a body made at least partially from a rubber, wherein the rubber has an amount of curing that varies circumferentially along an inner surface and does not vary circumferentially along an outer surface, wherein the amount of curing is between about 50% and at most 90% cured such that a fatigue life of the rubber at the about 50% cured is higher than the fatigue life of the rubber the at most 90% cured, the inner surface further defining a bore through the body wherein the inner surface is configured to cooperate with a rotor and to receive a drilling fluid therethrough.

2. The stator of claim 1, wherein the rubber defines a curing gradient such that the rubber is more cured at the outer surface thereof and less cured at the inner surface thereof, wherein the at least a portion of the rubber that is between about 50% and at most about 90% cured includes the inner surface.

3. The stator of claim 2, wherein the outer surface is configured to interface with a tube of the mud motor.

4. The stator of claim 1, wherein the at least a portion of the rubber is between about 50% to at most 70% cured.

5. The stator of claim 1, wherein the at least a portion of the rubber is between about 70% cured and about 90% cured.

6. The stator of claim 1, wherein the bore comprises a helical inner bore comprising alternating lobes and chambers, wherein a radial thickness of the body is greater at the lobes than at the chambers, and wherein the rubber forming the inner surface at the lobes is less cured than the rubber forming the inner surface at the chambers.

7. The stator of claim 6, wherein the at least a portion of the rubber that is between about 50% and at most about 90% cured is at the inner surface at the lobes and not at the inner surface at the chambers.

8. The mud motor comprising the stator of claim 1 and a rotor extending through the stator.

9. A method for manufacturing a stator for a mud motor, the method comprising:

positioning a rubber body in a mold comprising a tube and a core, such that the rubber body defines a helical inner bore about the core, wherein the rubber body is substantially uncured;

selecting, based at least in part on fatigue life of the rubber body, a curing percentage for at least a portion of the rubber body prior to heating the rubber body;

curing the rubber body at a temperature and for a time sufficient to cure at least the portion of the rubber body by the curing percentage, wherein the curing percentage is between about 50% and at most about 90%;

allowing the rubber body to cool so as to maintain the portion of the rubber body at between about 50% and about 90% cured, wherein the rubber body is cured less at an inner bore thereof than at an outer surface thereof, and the inner bore is configured to cooperate with a rotor of the mud motor; and removing the core of the mold from the rubber body.

10. The method of claim 9, wherein the rubber body defines a curing gradient such that the rubber body is more cured at the outer surface thereof and less cured at the inner bore.

11. The method of claim 9, further comprising:

removing the core of the mold from the rubber body without further curing the rubber body; and assembling the mud motor including the rubber body as at least a portion of the stator.

12. The method of claim 9, wherein curing the rubber body comprises submerging the rubber body and the mold in a vulcanization bath or positioning the rubber body and the mold in an autoclave.

13. The method of claim 9, wherein the rubber body is cured between 70% cured and 90% cured.

14. The method of claim 9, further comprising:

obtaining physical characteristics for the rubber body and the mold; and determining the time and the temperature for heating the rubber body by simulating a curing process based at least in part on the physical characteristics, prior to heating the rubber body.

15. The method of claim 14, further comprising selecting the curing percentage based at least in part on Young's modulus of the rubber body, mechanical strength of the rubber body, abrasion resistance of the rubber body, finite element analysis (FEA) simulation of the rubber body, or any combination thereof.

16. A method, comprising:

obtaining a mud motor having a stator made at least partially from a rubber, wherein at least a portion of the rubber at an inner surface of the stator is cured by between about 50% and at most about 90% selected based at least in part on fatigue life of the rubber, wherein the inner surface defines a bore through the stator;

deploying the mud motor into a well as part of a drill string, wherein the rubber is not further cured prior to deploying the mud motor into the well; and generating torque using the mud motor by pumping a mud through the bore of the stator.

17. The method of claim 16, wherein the rubber is further cured in a downhole environment when deployed into the well.

18. The method of claim 16, wherein the inner surface comprises alternating lobes and chambers, and the rubber defines a curing gradient, such that the inner surface of the lobes is cured by between about 50% and at most about 90%, and the inner surface of the chambers is cured by more than the inner surface of the lobes.

19. The method of claim 16, wherein the at least a portion of the rubber is cured by between about 70% and about 90%.

* * * * *